US005597219A

United States Patent [19]

Horn et al.

[11] Patent Number: 5,597,219

[45] Date of Patent: Jan. 28, 1997

[54] MOBILE RECEPTACLES FOR CIGARETTE TRAYS

[75] Inventors: Matthias Horn, Ahrensburg; Peter Kägeler, Geesthacht; Christian Kreusch, Berlin, all of Germany

[73] Assignee: Hauni Maschinenbau AG, Hamburg, Germany

[21] Appl. No.: 382,919

[22] Filed: Feb. 3, 1995

[30] Foreign Application Priority Data

Feb. 16, 1994 [DE] Germany ..... 44 04 901.3

[51] Int. Cl.[6] ..... A47B 88/00

[52] U.S. Cl. ..... 312/330.1; 312/322; 312/334.28; 312/334.1; 312/334.24; 312/35; 312/45; 312/350; 312/107; 211/50; 211/10; 220/23.4; 220/23.86

[58] Field of Search ..... 312/330.1, 35, 312/45, 72, 126, 127, 107, 350, 349, 334.27, 334.28, 333.24; 211/184, 126, 10; 220/553, 23.86, 23.83, 28.2, 23.4; 384/22, 38, 42

[56] References Cited

U.S. PATENT DOCUMENTS

| | | | |
|---|---|---|---|
| 511,894 | 1/1894 | Kahn | 312/334.28 X |
| 757,250 | 4/1904 | Beard | 312/334.28 |
| 1,083,415 | 1/1914 | Sorensen | 312/322 |
| 1,108,344 | 8/1914 | Davis | 312/322 X |
| 1,121,132 | 12/1914 | Richardson | 312/322 X |
| 1,133,889 | 3/1915 | Smith | 312/330.1 |
| 1,184,299 | 5/1916 | Bargreen | 312/350 X |
| 1,281,923 | 10/1918 | Fales | 312/334.28 X |
| 1,378,285 | 5/1921 | Schwartz | 312/322 X |
| 1,406,129 | 2/1922 | Noltz | 312/322 |
| 1,750,291 | 3/1930 | Whetstone | 312/330.1 X |
| 2,079,968 | 5/1937 | Ish-Shalom et al. | 312/330.1 X |
| 2,742,161 | 4/1956 | Nuttall | 211/50 X |
| 3,853,364 | 12/1974 | Lundberg | 312/334.28 X |
| 3,874,756 | 4/1975 | Greene | 312/334.24 X |
| 3,908,566 | 9/1975 | Frazelle et al. | 220/23.4 X |
| 3,972,094 | 8/1976 | Fuller | 211/10 X |
| 4,098,383 | 7/1978 | Chapman | 312/45 X |
| 4,124,260 | 11/1978 | Bergman | 312/107 |
| 4,153,127 | 5/1979 | Klink et al. | 312/350 X |
| 4,401,216 | 8/1983 | Koch | 220/23.4 X |
| 4,449,625 | 5/1984 | Grieben et al. . | |
| 4,564,329 | 1/1986 | Bantien . | |
| 4,892,453 | 1/1990 | Bantien et al. . | |
| 5,106,254 | 4/1992 | Tolasch et al. . | |
| 5,108,004 | 4/1992 | Baldwin | 220/23.86 X |
| 5,125,524 | 6/1992 | Hosoda et al. | 220/23.4 X |
| 5,299,688 | 4/1994 | McKay et al. | 220/23.4 X |

FOREIGN PATENT DOCUMENTS

| | | | |
|---|---|---|---|
| 82219 | 6/1983 | European Pat. Off. | 312/35 |
| 692475 | 11/1930 | France | 312/334.28 |
| 2675362 | 10/1992 | France | 312/270.3 |
| 922464 | 1/1955 | Germany | 312/334.28 |
| 1209707 | 1/1966 | Germany | 312/334.1 |
| 2018442 | 10/1971 | Germany . | |
| 6500830 | 8/1965 | Netherlands | 312/35 |
| 943077 | 11/1963 | United Kingdom | 312/350 |

*Primary Examiner*—Peter M. Cuomo
*Assistant Examiner*—Rodney B. White
*Attorney, Agent, or Firm*—Darby & Darby

[57] ABSTRACT

A box-shaped container for temporary storage of filled or empty cigarette trays defines a plurality of compartments for temporary storage of a set of trays. The compartments have open front sides for introduction or extraction of trays and at least partially open undersides to permit evacuation of tobacco particles and/or other solid particulate matter. The container is provided with pairs of tracks at the lower portions of upright or sloping partitions which flank the compartments, which extend to an upright rear wall of the container, and which are overlapped by a horizontal top wall of the container. The latter is or can be designed in such a way that the contents of filled trays in the compartments are at least substantially sealed from the surrounding atmosphere.

16 Claims, 5 Drawing Sheets

MOBILE RECEPTACLES FOR CIGARETTE TRAYS

BACKGROUND OF THE INVENTION

The invention relates to improvements in means for temporarily confining or storing and transporting receptacles of the type known as trays and used extensively in the tobacco processing industry for temporary storage of piles of plain or filter cigarettes, cigars, cigarillos, cheroots, filter rod sections and/or other rod-shaped articles of the tobacco processing industry.

Trays for confinement of piles of parallel rod-shaped articles of the tobacco processing industry are utilized in production lines wherein the articles are turned out by one or more makers and are to be transported to one or more processing machines. Typical examples of such production lines are those including one or more makers of plain or filter cigarettes and one or more packing machines. Let it be assumed that a single maker of filter cigarettes (the so-called filter tipping machine) is directly coupled to a single processing machine, e.g., a packing machine for filter cigarettes. As a rule, the filter cigarettes issuing from the tipping machine are caused to form a mass flow of parallel articles which move transversely of their longitudinal axes toward and into the magazine of the packing machine. Such mode of transporting articles between the tipping machine and the packing machine is highly satisfactory as long as the output of the tipping machine matches the requirements of the packing machine. Trays are put to use when the output of the tipping machine exceeds the momentary requirements of the packing machine or vice versa. Thus, the surplus of articles issuing from the tipping machine is stored in trays by a so-called tray filling apparatus, and the contents of filled trays are removed therefrom by so-called evacuating apparatus for introduction of the removed articles into the packing machine or into the path leading to the packing machine when the output of the tipping machine cannot match the momentary requirements of the packing machine. The filled trays can be said to constitute a magazine or buffer which takes up the surplus when the speed of the packing machine is less than the normal operating speed and which is relieved of some or all of the stored surplus when the speed of the tipping machine is less than the normal operating speed.

Commonly owned U.S. Pat. No. 4,892,453 discloses a production line wherein the trays are circulated along an endless path by a conveyance which delivers empty trays from tray evacuating apparatus to tray filling apparatus and delivers filled trays from the tray filling apparatus to the tray evacuating apparatus. The filling apparatus receives articles from the path for direct advancement of articles from the maker or makers to the consuming machine or machines, and the evacuating apparatus transfers articles from filled trays into the path for direct advancement of articles to the consuming machine(s). Such mode of operation ensures that the maker or makers need not be arrested when the speed of the consuming machines(s) is less than normal operating speed, and that the consuming machine(s) need not be arrested in immediate response to each reduction of the speed of the maker(s) to less than normal operating speed. The filled trays can be maintained in the state of readiness for evacuation of their contents for relatively short intervals of time or for relatively long intervals (e.g., one or more hours).

The utilization of trays for temporary storage of cigarettes or other rod-shaped articles of the tobacco processing industry is also desirable and advantageous in production lines wherein the maker or makers are designed for the production of relatively small lots of articles of a particular type (e.g., relatively small quantities of selected brands of plain or filter cigarettes) and for rapid conversion for the production of other brands. A drawback of heretofore known proposals is that the conventional means for confining and transporting empty and filled trays in or in combination with such production lines are not entirely satisfactory, e.g., because the moisture content of tobacco in stored rod-shaped articles is greatly reduced after relatively short periods of storage.

Certain types of presently known containers for empty and filled trays serving for temporary storage of rod-shaped articles of the tobacco processing industry are described and shown in commonly owned U.S. Pat. No. 4,449,625 granted on May 22, 1984 to Karl H. Grieven et al. for "Apparatus for transporting trays for cigarettes or the like". Other presently known containers for cigarette trays are disclosed in commonly owned U.S. Pat. No. 4,564,329 granted Jan. 14, 1986 to Jürgen Bantien for "Apparatus for manipulating empty and filled trays for cigarettes or the like between making and processing machines". Commonly owned U.S. Pat. No. 5,106,254 granted Apr. 21, 1992 to Gerhard Tolasch et al. for "Apparatus for filling and emptying trays for rod-shaped articles of the tobacco processing industry" discloses certain presently preferred types of tray filling and tray emptying or evacuating apparatus. The disclosures of all of the aforementioned commonly owned patents are incorporated herein by reference.

A method and an apparatus suitable for the manipulation of containers of the type embodying the present invention are disclosed in commonly owned copending patent application Ser. No. 08/383,084 filed Feb. 2, 1995 by Matthias Horn and Peter Kägeler for "Method of and apparatus for manipulating containers for cigarette trays".

OBJECTS OF THE INVENTION

An object of the invention is to provide a novel and improved receptacle or container for temporary storage and transport of filled and empty trays for rod-shaped articles of the tobacco processing industry.

Another object of the invention is to provide a container which can store filled trays for extended periods of time without affecting the moisture content and/or other characteristics of the stored articles.

A further object of the invention is to provide a novel and improved combination or kit including a container of the above outlined character and one or more empty or filled trays therein.

An additional object of the invention is to provide novel and improved trays which can be utilized for temporary storage of rod-shaped articles of the tobacco processing industry.

Still another object of the invention is to provide a container which can repeatedly receive and store selected numbers or sets of empty or filled trays in predetermined positions relative to each other and relative to the container.

A further object of the invention is to provide the improved container with novel and improved means for temporarily confining and retaining empty and/or filled trays therein.

Another object of the invention is to provide the improved container with means for predictably locating, releasably locking and optimally orienting empty and/or filled trays therein.

An additional object of the invention is to provide a container which is constructed and assembled in such a way that the articles in filled trays within the container are automatically held against undesirable longitudinal and/or other displacement relative to the respective filled tray or trays.

Still another object of the invention is to provide a container which is designed to store one or more filled or partly filled trays for extended intervals of time, such as one or more days or one or more weeks, without affecting the quality of confined rod-shaped articles.

A further object of the invention is to provide a simple, inexpensive and compact container which occupies little room in storage, at the station for reception of filled or empty trays and at the station for evacuation or removal of filled or empty trays.

SUMMARY OF THE INVENTION

The invention is embodied in a mobile container which is designed for temporary storage or confinement and transport of receptacles (known as and hereinafter called trays) for temporary storage of plain or filter cigarettes, cigarillos, cigars, filter rod sections or other rod-shaped articles of the tobacco processing industry. The improved container comprises a plurality of walls which define a plurality of tray receiving compartments.

As a rule, trays for temporary storage of rod-shaped articles of the tobacco processing industry (hereinafter called cigarettes for short) are designed in such a way that they have open sides for introduction and/or withdrawal of piled-up cigarettes. The container for temporary confinement of such trays is or can be provided with means for at least substantially sealing the compartments from the surrounding atmosphere when the compartments are filled, i.e., when they contain filled or empty trays. This reduces the likelihood of excessive drying of tobacco in the cigarettes during confinement in trays which, in turn, are confined in the compartments of the improved container.

The walls of a presently preferred embodiment of the improved container include a top wall, a rear wall, a plurality of first partitions including two spaced-apart outermost partitions or sidewalls which flank the top wall and the rear wall and which also flank a plurality of additional or intermediate partitions. The intermediate partitions are also spaced apart from each other and each compartment is disposed between two partitions. Each compartment has an underside located opposite the top wall and, being at least substantially open, and an open front side opposite the rear wall. Such container preferably further includes tracks (e.g., in the form of elongated strips or rails) which define paths for introduction of filled or empty trays into the compartments through the respective open front sides and for withdrawal of empty or filled trays from the compartments through the respective open front sides. The tracks are or can be adjacent the undersides of the compartments; for example, such tracks can be carried by or can be of one piece with the lower portions of the partitions.

At least some of the partitions can be provided with suitable orienting members. The trays are insertable into the compartments through the respective open front sides in a direction toward the rear wall. The orienting members extend or can extend substantially transversely of such direction. At least some of the orienting members can be disposed substantially midway between the rear wall and the open sides of the respective compartments. Such orienting members can extend substantially all the way between the top wall of the container and the undersides of the respective compartments.

The container can further comprise means for limiting the extent of movability of trays through the open front sides of the respective containers and toward the rear wall. Such limiting means can comprise resilient abutments or buffers which are or can be provided on the rear wall of the container. For example, the rear wall can carry one or more resilient abutments for each compartment.

The container can also comprise sealing elements which are disposed at the rear wall and extend transversely of the partitions adjacent the undersides of the compartments. Such sealing elements can be engaged by trays which are introduced through the open front sides of and into the respective compartments.

Still further, the container can comprise yieldable tray retaining devices which are provided in the compartments, preferably at the top wall, and serve to yieldably hold trays in the respective compartments. Each such retaining device can consist, at least in part, of resilient metallic and/or plastic sheet material.

The aforementioned tracks for the trays can further serve as supports for the partitions.

The additional partitions can make oblique angles with the top wall and with the sidewalls. Such container can be utilized with advantage for temporary confinement of trays having open sides and closed sides opposite the open sides. The additional partitions are adjacent the closed sides of trays in the respective compartments and the cigarettes are stacked in such trays with a view to ensure that they tend to abut the respective closed sides.

If the improved container is designed for temporary confinement or storage of trays having open sides, closed sides opposite the respective open sides, open tops and closed bottoms opposite the respective open tops, the container can be provided with first and second ramps which are respectively provided on at least some of the partitions and at the undersides of the compartments to respectively engage and shift the closed sides and the closed bottoms of trays, at least during preselected stages (particularly the last stages) of introduction of trays through the open front sides of the compartment and toward the rear wall. The ramps ensure that the open tops of properly inserted trays are sealed by the adjacent portions of the top wall and that the open sides of the properly inserted or confined trays are sealed by the adjacent partitions of the container.

The trays which are to be confined in the compartments of a container which is provided with the aforementioned first and second ramps can be provided with additional ramps, particularly with third and fourth ramps which are respectively complementary to the first and second ramps of the container, i.e., which can respectively cooperate with the first and second ramps. The first and second ramps are positioned for engagement by the third and fourth ramps, respectively, in response to introduction of trays having third and fourth ramps into the compartments of such container.

The second ramps of the container can be disposed at least substantially midway between pairs of the aforementioned tracks or supports. The tracks of such container include a pair of tracks for each compartment and such tracks are affixed to or are otherwise engaged by the partitions and are disposed at the undersides of the respective compartments. The second ramps of the container can include rear ramps disposed at a first distance from the rear wall and at a first distance from the top wall, and front ramps disposed at a greater second distance from the rear wall and at a greater second distance from the top wall of the container.

The trays can be provided with elongated slots which extend between the respective fourth ramps at least substantially at right angles to the rear wall upon completed introduction of trays into the compartments.

The first ramps of the container can include a first pair provided in each compartment on one of the respective partitions adjacent the rear wall, and a second pair provided in each compartment on the one partition adjacent the open front sides of the respective compartments. The first pairs of ramps are disposed at first distances from the top wall and the second pairs are disposed at different second distances from the top wall.

The novel features which are considered as characteristic of the invention are set forth in particular in the appended claims. The improved container itself, however, both as to its construction and the mode of utilizing the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
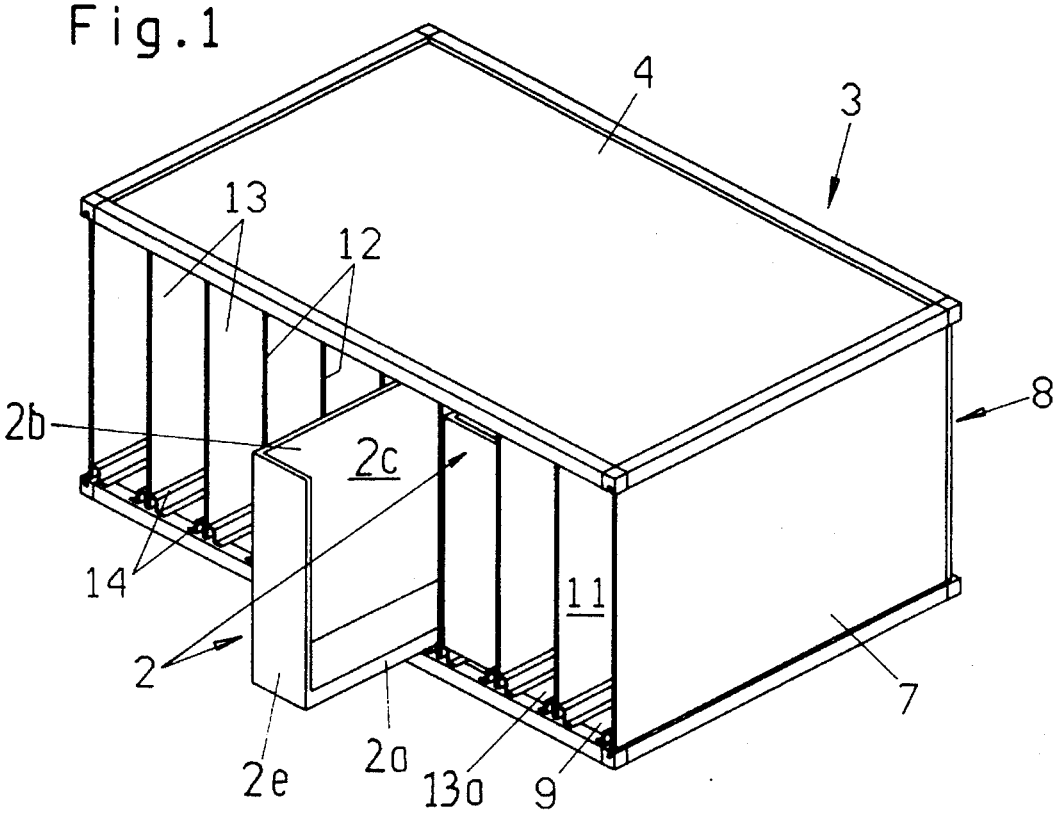
FIG. 1 is a schematic perspective view of a container which embodies one form of the invention, an empty tray being shown in a partly inserted or partly extracted position.
Figure 2:
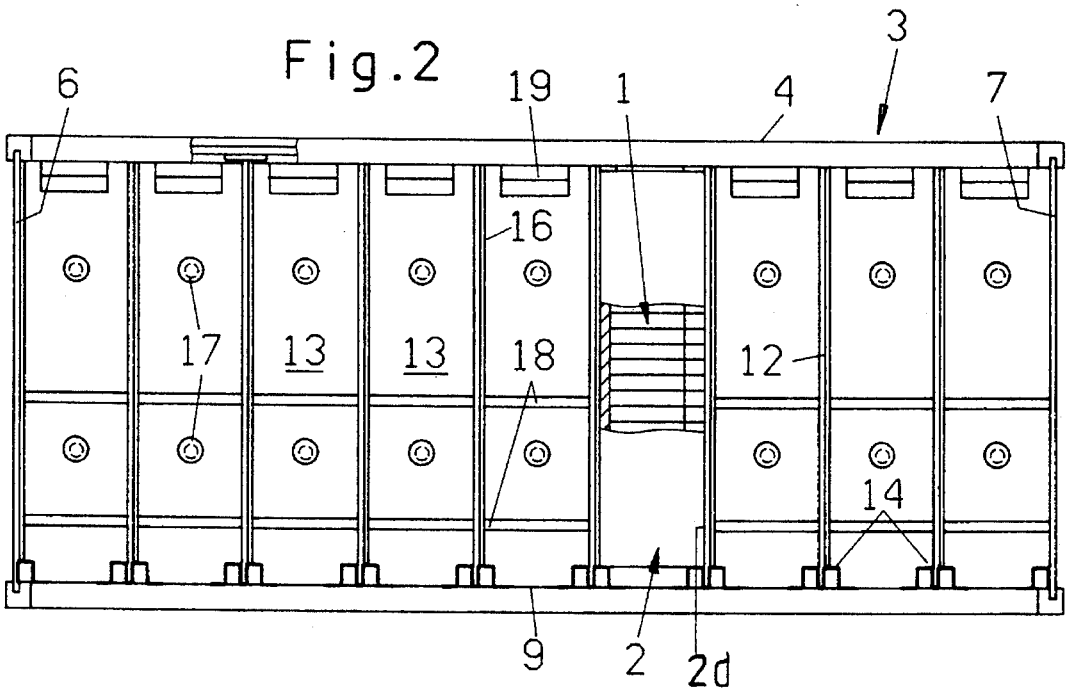
FIG. 2 is an enlarged front elevational view of the container of FIG. 1, portions of the top wall of the container and of a tray being broken away.
Figure 3:
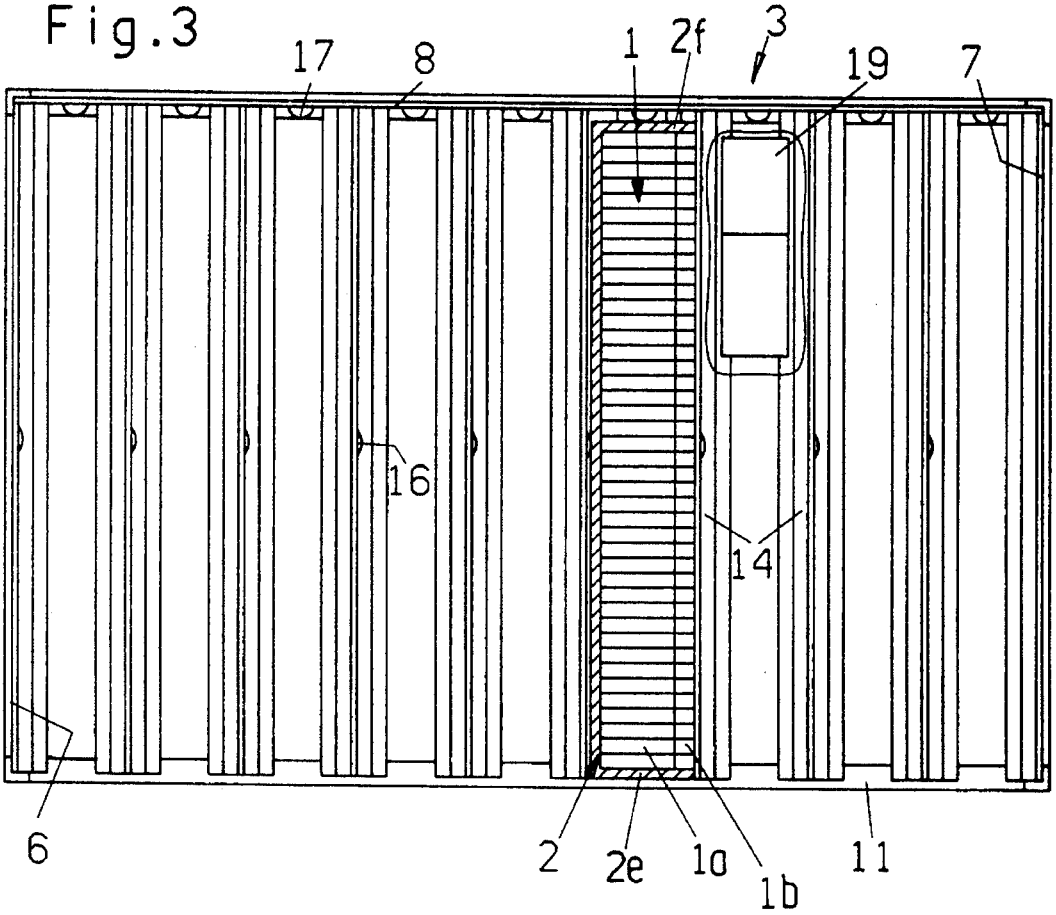
FIG. 3 is a plan view of the container of FIG. 2, with the top wall removed and with a filled tray shown in fully inserted or confined position.

The substantially box-shaped container 3 which is shown in FIGS. 1 to 4 serves for temporary confinement of sets of nine trays or receptacles 2 which, in turn, serve for temporary storage of piles of parallel rod-shaped articles 1 of the tobacco processing industry, e.g., plain or filter cigarettes. Each of the trays 2 shown in FIGS. 1 to 3 has a bottom 2*a*, an open top 2*b*, a closed side 2*c*, an open side 2*d* opposite the closed side 2*c*, and two upright sidewalls 2*e*, 2*f*. The articles which are shown in FIGS. 2 and 3 are filter cigarettes each having a tobacco containing portion 1*a* and a filter mouthpiece 1*b*.

The container 3 comprises a top wall 4, a rear wall 8 and ten upright partitions including two outer partitions or sidewalls 6, 7 which flank the walls 4, 8 and eight additional or intermediate partitions 12 which are parallel to each other and to the partitions or sidewalls 6, 7 and normal to the walls 4 and 8. The partitions 6, 7 and 12 define nine relatively narrow upright compartments 13 each of which is flanked by a pair of partitions and extends all the way to the inner side of the rear wall 8. The front sides 11 of the compartments 13 are open to permit insertion or extraction of discrete empty or filled trays 2, and the undersides 13*a* of the compartments 13 are at least partially open in order to permit particles of tobacco and/or other solid particles to escape from the container 3. The undersides 13*a* together constitute the partially open underside 9 of the container 3.

The inner side of each sidewall or outer partition 6, 7 carries a single elongated track 14 which is adjacent the underside 9 of the container 3, and each intermediate or additional partition 12 carries two elongated tracks 14 which are also adjacent the underside 9 of the container 3. The pairs of confronting tracks 14 define in each compartment 13 alongated paths for controlled introduction of empty or filled trays 2 into or for controlled extraction or removal of empty or filled trays 2 from the respective compartments 13. Each compartment 13 can sealingly receive a fully inserted tray 2 which is particularly important when the trays are filled with cigarettes 1. Thus, the container 3 is designed to automatically seal the open top 2*b* and the open side 2*d* of a tray 2 which has been properly inserted into a selected compartment 13.

The trays 2 are designed to stand twisting and/or other deforming stresses irrespective of whether or not they contain piles or similar accumulations of cigarettes 1. The means for inserting empty or filled trays 2 into and/or for withdrawing filled or empty trays 2 from the compartments 13 can include mechanical and/or other (such as fluid operated) devices, not shown. Reference may be had to the aforementioned copending patent application Ser. No. 08/383,084 of Matthias Horn et al. for "Method of and apparatus for manipulating containers for cigarette trays" which discloses pneumatic suction cups capable of engaging the adjacent upright sidewalls (such as 2*e* or 2*f*) of empty or filled trays in order to push empty or filled trays into or to pull empty or filled trays from their compartments in the container.

The aforementioned means for sealing the open tops 2*b* and open sides 2*d* of empty or filled trays 2 in response to full insertion into the respective compartments 13 can include elongated orienting members 16 each of which is provided at the inner side of one partition (6, 7 or 12) flanking each compartment 13 and extends vertically or nearly vertically all the way or nearly all the way between the top wall 4 and the partly open underside 9 of the container 3 to be engaged by the closed side 2*c* of the tray 2 in the respective compartment and to thus cause the open side 2*d* of the respective tray 2 to be sealed by the adjacent partition 12 or 7. The tracks 14 can be said to constitute or form part of the means for sealing the open tops 2*b* of trays 2 in the compartments 13 in that the tracks maintain the open tops 2*b* at a level immediately beneath the underside of the top wall 4 of the container 3.

Airtight sealing of trays 2 in their compartments 13 is particularly desirable and advantageous when the trays confine accumulations of tobacco-containing articles such as plain or filter cigarettes. This ensures that the moisture content of the confined articles does not change for extended periods of time, e.g., one or more days or one or more weeks. Each orienting member 16 can be mounted on the respective partition 6, 7 or 12 substantially midway between the rear wall 8 and the open front side 11 of the respective compartment 13. As mentioned above, each orienting member 16 can (but need not always) extend all the way between the top wall 4 and the partly open underside 9 of the container 3.

The container 3 further comprises means for limiting the extent of movability of trays 2 through the open front sides 11 of the respective compartments 13 and toward the rear wall 8. The illustrated limiting means includes resilient abutments 17 (e.g., in the form of rubber pads or the like) which are bonded or otherwise affixed to the inner side of the rear wall 8. The rear wall 8 can carry at least one abutment 17 in each compartment 13 of the container 3. The abutments 17 constitute optional features of the compartment 3 if the aforediscussed means for introducing trays 2 into and/or for withdrawing trays from the compartments 13 includes stepping motors or analogous prime movers which can move the trays through accurately selected distances.

Figure 4:
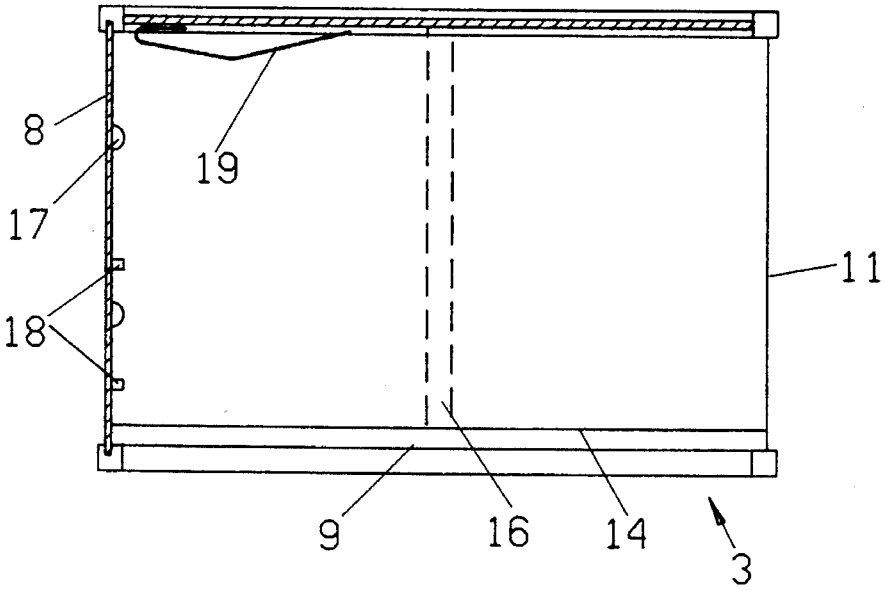
FIG. 4 is a transverse sectional view of the container taken in a plane which is parallel to and extends between two partitions.

Adequate sealing of confined trays 2 in their compartments 13 can be further enhanced by the provision of additional sealing means which become effective when the trays 2 are fully inserted into the selected compartments. FIGS. 2 and 4 show sealing elements 18 in the form of elastic lips or analogous strips which are applied to the inner side of the rear wall 8 and are engaged by the outer sides of the upright sidewalls **2*f* of the fully inserted trays. The sealing elements 18 which are shown in FIGS. 2 and 4 extend transversely of the partitions 6, 7, 12 close to the open underside 9 of the container 3 so that they prevent atmospheric air from flowing through the underside 9 and along the inner side of the rear wall 8 into the open tops 2*b* and/or into the open sides 2*d* of the properly inserted trays 2**.

Still further, the container 3 is provided with yieldable tray retaining devices 19 which are located at the inner side of the top wall 4 and serve to releasably engage and hold properly inserted trays 2 in their selected compartments 13. The retaining devices 19 are provided primarily for the purpose of preventing accidental or other unintentional shifting of fully inserted empty or filled trays 2 in their compartments 13 during transport of the container to or from a tray filling machine and/or to or from a tray emptying or evacuating machine. The illustrated retaining devices 19 include suitably configurated sheets or panels of resilient metallic and/or plastic material each having a portion bonded, riveted or otherwise affixed to the top wall 4. Such retaining devices are engaged by the upper end portions of the closed sides **2*c*, by the upper end portions of sidewalls 2*e* and/or by the upper end portions of the sidewalls 2*f* of fully inserted trays 2 in their compartments 13**.

The box-shaped container 3 can be assembled with similar containers into stacks or other accumulations which occupy a small amount of floor space.

The aforementioned tracks 14 can serve as a means for guiding empty or filled trays 2 on their way into or from selected compartments 13 and also as supports for the partitions 6, 7 and/or 12. For example, the rear end portions of the tracks 14 can be reliably secured to the rear wall 8. In addition, the tracks 14 can perform the desirable function of urging the top portions of the closed sides **2*c* as well as the top portions of the sidewalls 2*e*, 2*f* of fully inserted trays 2 against the underside of the top wall 4 to thus reduce the likelihood of communication of the internal spaces of the inserted trays 2 with the interior of the container 3** but particularly with the surrounding atmosphere.

Figure 5:
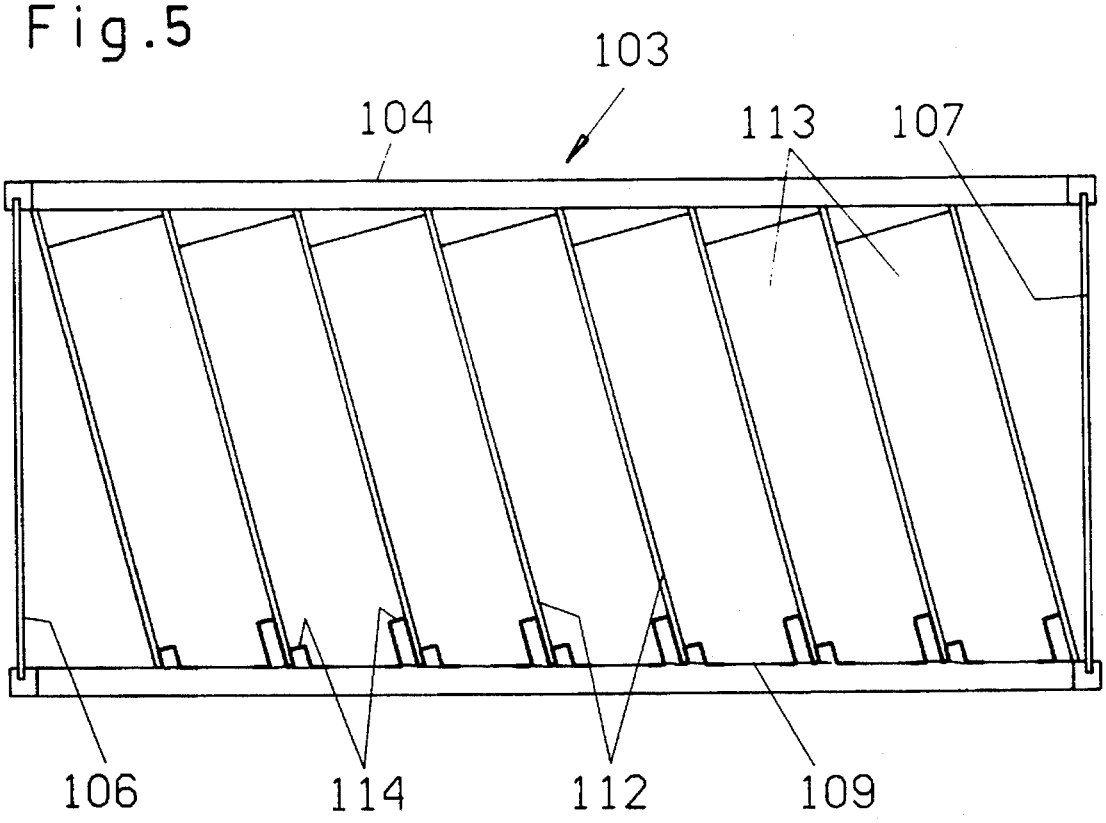
FIG. 5 is a front elevational view of a modified container with inclined intermediate or additional partitions.

A container 3 which confines one or more filled or at least partially filled trays 2 wherein the mouthpieces **1*b* are remote from the respective closed sides 2*c* can be stored and transported with its top wall 4 and underside 9 in horizontal or nearly horizontal positions. The reason is that, in many instances, the diameters of the mouthpieces 1*b* are slightly larger than the diameters of the tobacco containing portions 1*a* of the articles 1 so that the open ends of the tobacco containing portions 1*a* tend to abut against the closed sides 2*c* of the corresponding trays 2. On the other hand, if the articles 1 are stored in their trays in such a way that the mouthpieces 1*b* are adjacent the closed sides 2*c*, the articles 1 at the top of a pile in a tray 2 exhibit the tendency to slide away from the respective closed side 2*c*. Therefore, such trays are or can be advantageously confined in compartments 113 of the type shown in FIG. 5. The container 103 has a top wall 104, two outer partitions or sidewalls 106, 107 which are normal to the top wall 104 and to the rear wall, and a plurality of intermediate or additional partitions 112 which make oblique angles with the top wall 104 but are also normal to the rear wall of the container 103. The inclinations and the dimensions of the tracks 114 at the lower ends of the compartments 113 are selected in such a way that the closed sides 2*c* of trays 2 in such compartments lie against the adjacent left-hand intermediate or additional partitions 112 (as viewed in FIG. 5) so that the articles 1 do not tend to slide in a direction to the right even if their mouthpieces 1*b* are adjacent the left-hand partitions 112 bounding the respective compartments. Such design of the container 103 renders it possible to store and/or transport it with the top wall 104 located in a horizontal or nearly horizontal plane. The underside 109 of the illustrated container 103 is also located in a horizontal plane, i.e., it is or can be parallel to the top wall 104**.

FIGS. 6 to 10 illustrate the details of a further container 203 and of a tray 202 which can be confined in a selected compartment 213 of such container. All such parts of the container 203 and of the tray 202 which are identical with or clearly analogous to the corresponding parts of the container 3 and tray 2 of FIGS. 1 to 4 are denoted by similar reference characters plus 200.

The means for sealing properly and fully inserted trays 202 in the selected compartments 213 of the container 203 includes a plurality of suitably distributed ramps which, in the embodiment of FIGS. 6 to 10, are carried by or are integral with the inner sides of the sidewalls or outer partitions 206, 207, with one side of each intermediate partition 212, with the front and rear ends of the tracks 214 and with the trays 202. The ramps of a tray 202 are caused to slide along selected ramps of the container 203 during insertion of the tray into a selected compartment so that the tray is urged upwardly and in a direction to the left, as viewed in FIG. 6, in order to ensure that its open top is immediately adjacent the underside of the top wall 204 and that its open side is immediately adjacent the respective left-hand partition (206 or 212 in FIG. 6).

Figure 8:
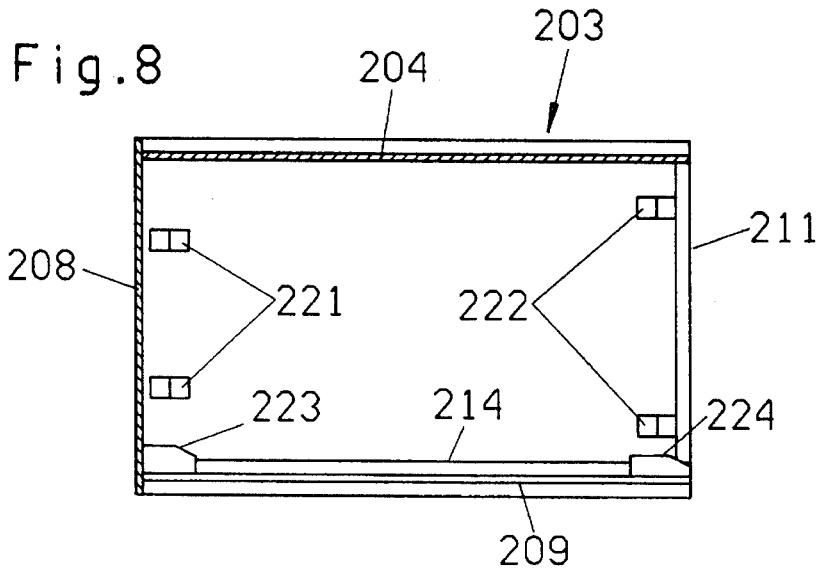
FIG. 8 is a transverse vertical sectional view of the container of FIGS. 6 and 7 in a plane which is normal to the rear wall and extends between two partitions.
Figure 9:
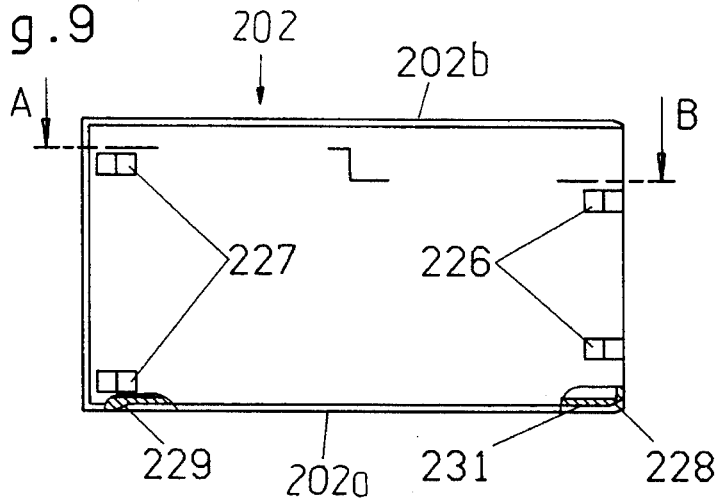
FIG. 9 is a side elevational view of a tray which can be confined in the container of FIGS. 6 to 8.
Figure 10:
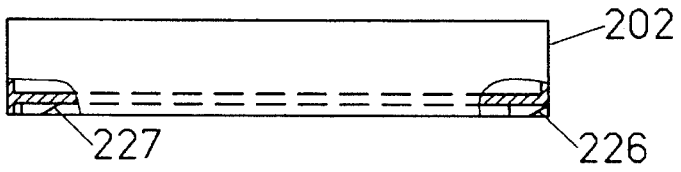
FIG. 10 is a sectional view substantially as seen in the direction of arrows from the line A-B in FIG. 9.

FIG. 8 shows that the sidewall or outer partition 207 and each intermediate partition 212 carries a pair of vertically spaced apart first ramps 221 which are closely adjacent the rear wall 208 and are disposed at first distances from the top wall 204, and a pair of vertically spaced apart second ramps 222 which are more distant from the rear wall 208 (they are closely or immediately adjacent the open front sides 211 of the respective compartments 213) and are disposed at different second distances from the top wall 204. The ramps 221 are disposed at levels between the levels of the ramps 222. The rear end portion of each track 214 carries a taller ramp 223, and the front end portion of each track 214 carries a shorter or lower ramp 224.

The ramps 221, 222, 223 and 224 of the container 203 respectively cooperate with the ramps 226, 227, 228 and 229 of the trays 202 during introduction of trays into the selected compartments 213. The spacing of the ramps 227 is such that they engage and slide along the ramps 222 in the respective compartment 213 and the ramps 226 then engage and slide along the respective ramps 221. The shorter or lower ramps 229 are dimensioned to slide along the taller ramps 223, and the taller ramps 228 are caused to slide along the lower ramps 224. The ramps 226, 227 are provided at the exteriors of the closed sides of the trays 202, and the ramps 228, 229 are provided at the closed bottoms of the respective trays 202. The ramps can be designed to yield (or one of each pair of cooperating ramps can be designed to yield) so that they can compensate for certain tolerances without unduly affecting their sealing action.

As can be seen in FIGS. 6 to 10, the distribution of the ramps 221 to 224 on the container 203 and of the ramps 226 to 229 on each tray 202 is or can be such that the ramps of a moving tray engage the complementary ramps of the container only during one or more certain stages of insertion of the tray into a selected compartment 213. This is desirable and advantageous on the ground that, if the ramps 226–229 of a tray 202 engage the ramps 221–224 in the selected compartments 213 during the last stage of insertion of such tray, the initial stage of introduction of the tray does not necessitate highly accurate aiming of the one or the other sidewall of a tray 202 into the open front side 211 of the selected compartment 213.

Figure 6:
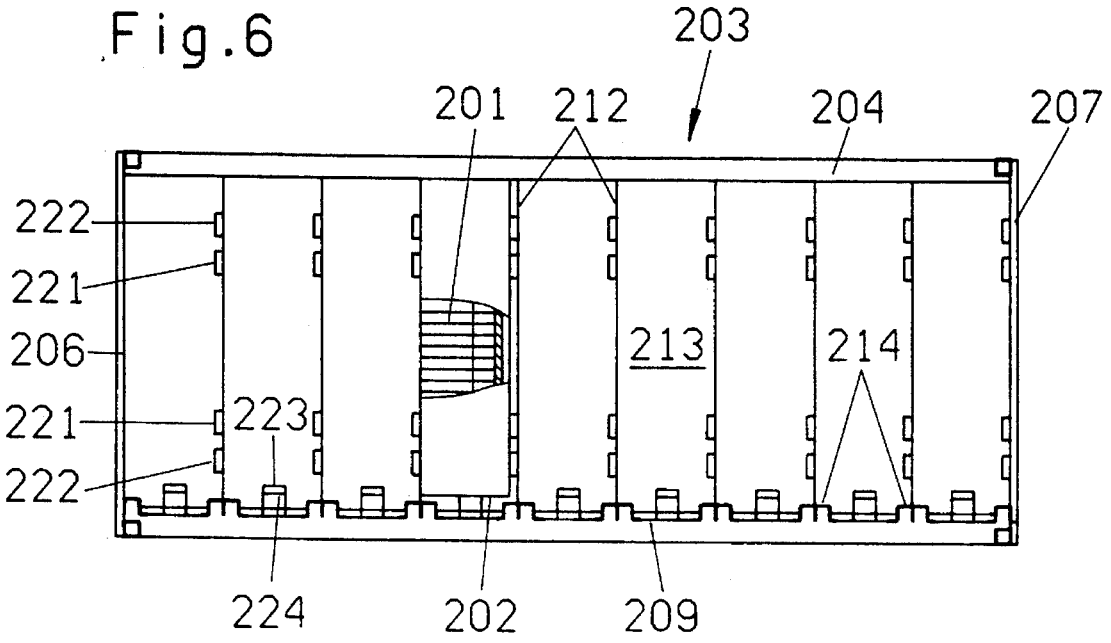
FIG. 6 is a front elevational view of a third container ad of a modified tray which is confined in one of the compartments.
Figure 7:
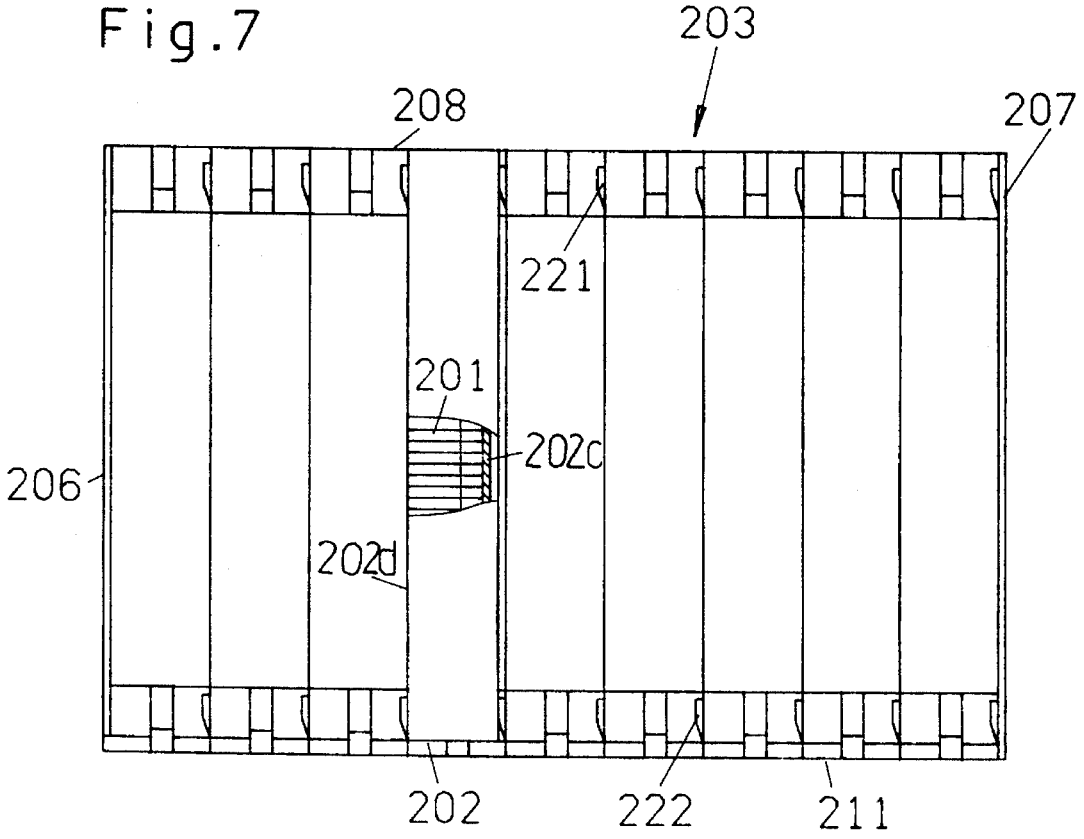
FIG. 7 is a plan view of the container of FIG. 6, with the top wall removed and a fully inserted filled tray partially broken away.

The ramps 223, 224 are or can be disposed at least substantially midway between the tracks 214 in the respective compartments 213 (see FIG. 6).

The bottom of each tray 202 can be provided with a longitudinally extending slot 231 disposed between the respective ramps 228 and 229. The slots 231 are parallel to the direction of introduction of a tray 202 into or its extraction from the selected compartment 213. These slots can compensate for tolerances and/or thermally induced expansion or contraction of the container and/or trays.

The features of various embodiments of the improved containers and/or trays can be utilized interchangeably and/or in any suitable combinations with each other. The container 203 and the tray 202 of FIGS. 6 to 10 exhibit the important advantages that a tray can be loosely inserted into the open side of a selected compartment 213 but is compelled to assume a predetermined optimum position relative to the container not later than during the last stage of introduction to thus ensure practically airtight sealing of the contents of a properly inserted and at least partially filled tray from the surrounding atmosphere. As already pointed out hereinbefore, such sealing is particularly important and advantageous if the contents of one or more filled trays are to be confined in a container for relatively long or very long intervals of time.

The improved containers exhibit the additional advantage that they occupy little space in storage and/or during transport, that they can be transported (e.g., pushed or pulled) by rudimentary moving means, and that they can be mass produced at a low cost. Moreover, they can confine filled trays in such a way that the orientation of confined articles does not change during introduction of trays into the containers, during removal of trays from the containers and/or during transport of trays with the containers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. A mobile container adapted or temporary confinement and transport of trays each having an open side, a closed side opposite the open side, an open top and a closed bottom opposite the open top, comprising a plurality of walls defining a plurality of tray receiving compartments, said walls including a top wall, a rear wall, a plurality of first partitions including two spaced-apart sidewalls flanking said top wall and said rear wall, and a plurality of additional partitions spaced apart from each other and from said sidewalls, each of said compartments being flanked by two of said partitions and each having an at least substantially open underside an an open front side opposite said rear wall; and first and second ramps respectively provided on at least some of said partitions and at the undersides of said compartments to respectively engage and shift the closed sides and the closed bottoms of trays through the open front sides of said compartments and toward said rear wall.

2. The container of claim 1 adapted for temporary confinement of trays having third and fourth ramps complementary to said first and second ramps, respectively, said first and second ramps being positioned for engagement by said third and fourth ramps, respectively, in response to introduction of trays into said compartments.

3. The container of claim 1, further comprising pairs of tracks defining paths for introduction of trays into, and for withdrawal of trays through, the open sides of said compartments, each pair of tracks being adjacent the underside of a discrete compartment and each of said second ramps being disposed at least substantially midway between a pair of tracks.

4. The container of claim 3, wherein said second ramps include rear ramps disposed at a first distance from said rear wall and at a first distance from said top wall, and front ramps disposed at a greater second distance from said rear wall and at a greater second distance from said top wall.

5. The container of claim 1 adapted for temporary confinement of trays having third and fourth ramps complementary to said first and second ramps, respectively, said first and second ramps being positioned for engagement by said third and fourth ramps, respectively, in response to introduction of trays into said compartments, each tray having an elongated slot extending between the fourth ramps thereof and at least substantially at right angles to said rear wall upon introduction of trays into said compartments.

6. The container of claim 1, wherein said first ramps include a first pair provided in each compartment on one of the partitions flanking the compartment and adjacent said rear wall, and a second pair provided in each compartment on said one partition adjacent the open front side of the compartment, said first pairs being disposed at first distances from said top wall and said second pairs being disposed at different second distances from said top wall.

7. A receptacle insertable in a compartment and designed for rod-shaped articles of the tobacco processing industry, said receptacle comprising at least one wall constituting a bottom wall of the receptacle; at least one first ramp on said at least one wall for causing said receptacle to shift upon insertion into the compartment; and a second ramp on said at least one wall, each of said ramps having a first surface which is arranged to engage one of a plurality of second surfaces of the compartment, said first surfaces being disposed at different levels.

8. The receptacle of claim 7, further comprising another wall transverse to said at least one wall, and at least one additional ramp on said other wall for causing said receptacle to shift upon insertion into the compartment.

9. The receptacle of claim 8, wherein said other wall is a side wall of said receptacle.

10. The receptacle of claim 7, wherein said at least one wall has an external surface and said at least one first ramp is provided on said external surface.

11. The receptacle of claim 7, wherein said at least one first ramp is arranged to cause shifting of said receptacle when insertion of said receptacle in the compartment approaches completion.

12. The receptacle of claim 7, wherein said at least one wall has a bottom surface, a first one of said at least one first ramp and said second ramp having a bottom which is substantially flush with said bottom surface, and the second one of said at least one first ramp and said second ramp extending upward from said at least one wall and having a bottom which is located at a level above said bottom surface.

13. The receptacle of claim 12, wherein the compartment has two additional ramps which extend upwards to different levels, said at least one first ramp being arranged to cooperate with one of said additional ramps and said second ramp being arranged to cooperate with the other of said additional ramps, said one additional ramp extending to a level above the level of said other additional ramp.

14. The receptacle of claim 7, wherein said receptacle is insertable in the compartment in a predetermined direction and said at least one first ramp and said second ramp are spaced apart from one another in said direction, said at least one wall being provided with a slot which is situated between said at least one first ramp and said second ramp and runs in said direction.

15. A receptacle insertable in a compartment and designed for rod-shaped articles of the tobacco processing industry, said receptacle comprising at least one wall constituting a side wall of the receptacle; at least one first ramp on said at least one wall for causing said receptacle to shift upon insertion into the compartment; and three additional ramps on said at least one wall, said at least one first ramp and said three additional ramps being arranged in first and second pairs and the ramps of said first pair being disposed at first levels, the ramps of said second pair being disposed at second levels different from said first levels.

16. The receptacle of claim 15, wherein the compartment has a third pair of ramps and a fourth pair of ramps, the ramps of said first pair being arranged to cooperate with said third pair of ramps and the ramps of said second pair being arranged to cooperate with said fourth pair ramps.

* * * * *